US008500058B2

(12) United States Patent
Lan

(10) Patent No.: US 8,500,058 B2
(45) Date of Patent: Aug. 6, 2013

(54) PAPER ROLL FIXING DEVICE OF PRINTER

(75) Inventor: Chia-Tsui Lan, Taipei (TW)

(73) Assignee: Primax Electronics Ltd., Neihu (TW)

( * ) Notice: Subject to any disclaimer, the term of this patent is extended or adjusted under 35 U.S.C. 154(b) by 263 days.

(21) Appl. No.: 13/046,608

(22) Filed: Mar. 11, 2011

(65) Prior Publication Data

US 2012/0183342 A1 Jul. 19, 2012

(30) Foreign Application Priority Data

Jan. 14, 2011 (TW) ..... 100101400

(51) Int. Cl.
*B65H 75/24* (2006.01)

(52) U.S. Cl.
USPC ..... 242/578; 242/578.2; 242/578.3; 242/596; 242/596.3

(58) Field of Classification Search
USPC ..... 242/578, 578.1–578.3, 596, 596.1–596.3
See application file for complete search history.

(56) References Cited

U.S. PATENT DOCUMENTS

| | | | | |
|---|---|---|---|---|
| 2,905,404 | A * | 9/1959 | Simmons | 242/423.2 |
| 5,813,343 | A * | 9/1998 | Harb | 101/407.1 |
| 6,431,492 | B1 * | 8/2002 | Chillscyzn | 242/577 |
| 6,695,500 | B2 * | 2/2004 | Kim et al. | 400/613 |
| 7,381,002 | B2 * | 6/2008 | Sugimoto et al. | 400/613 |
| 8,047,462 | B2 * | 11/2011 | Yamada | 242/578 |

* cited by examiner

*Primary Examiner* — Sang Kim
(74) *Attorney, Agent, or Firm* — Tracy M. Heims; Apex Juris, pllc

(57) ABSTRACT

A paper roll fixing device of a printer includes a first supporting base, a second supporting base, a first fixing member and a second fixing member. The first fixing member comprises a rotatable first fixing slab. The second fixing member comprises a rotatable second fixing slab. When the first fixing slab and the first fixing slab are pushed by a paper roll, the first fixing slab and the first fixing slab are rotated to the position without stopping the paper roll from entering or leaving the space between the first supporting base and the second supporting base. As a consequently, the paper roll can be smoothly introduced into or removed from the paper roll fixing device. By the paper roll fixing device, the paper roll can be introduced into or removed from the paper roll fixing device with a single hand or in a single step.

8 Claims, 9 Drawing Sheets

PAPER ROLL FIXING DEVICE OF PRINTER

CROSS-REFERENCES TO RELATED APPLICATIONS

This non-provisional application claims priority under 35 U.S.C. §119(a) to Patent Application No(s). 100101400 filed in Taiwan, R.O.C. on Jan. 14, 2011, the entire contents of which are hereby incorporated by reference.

FIELD OF THE INVENTION

The present invention relates to a paper roll fixing device, and more particularly to a paper roll fixing device of a printer.

BACKGROUND OF THE INVENTION

In the markets, many conventional printers (e.g. label printers) use paper rolls as print media. The label printer usually has a paper roll fixing device for fixing the paper roll within the label printer. After the paper roll is fixed within the label printer, the task of printing the label paper can be performed by the printing mechanism of the label printer.

FIG. 1A is a schematic perspective view illustrating a label printer according to the prior art. The label printer 1 is disclosed in U.S. Pat. No. 6,431,492. As shown in FIG. 1A, a paper roll fixing device 11 is installed within the label printer 1. The paper roll fixing device 11 comprises a first supporting base 12 and a second supporting base 13. Please refer to FIG. 1B and FIG. 1C. FIG. 1B schematically illustrates the first supporting base 12, a first movable track 14 and a second movable track 15 of the paper roll fixing device 11. FIG. 1C schematically illustrates the second supporting base 13, the first movable track 14, the second movable track 15 and the gear 16 of the paper roll fixing device 11. The first supporting base 12 comprises a supporting protrusion part 12*a*. The second supporting base 13 comprises a supporting protrusion part 13*a*. The paper roll fixing device 11 further comprises the first movable track 14, the second movable track 15 and the gear 16. The first movable track 14 and the second movable track 15 are parallel with each other. An end 14*a* of the first movable track 14 is connected with the first supporting base 12. An end 15*a* of the second movable track 15 is connected with the second supporting base 13. The gear 16 is clamped between the first movable track 14 and the second movable track 15, and engaged with the first movable track 14 and the second movable track 15. Through the gear 16, the first movable track 14 and the second movable track 15 may be linearly moved back and forth in a reciprocating manner. In such way, the distance between the first supporting base 12 and the second supporting base 13 is adjustable.

For installing a paper roll within the label printer 1, a first end of the paper roll is firstly fixed on the first supporting base 12. That is, the first end of the paper roll is fixed by the supporting protrusion part 12*a*. Then, the second supporting base 13 is moved toward the first supporting base 12. During the process of moving the second supporting base 13, the second movable track 15 that is connected with the second supporting base 13 and the first movable track 14 that is connected with the first supporting base 12 are linearly moved through the gear 16. As a consequence, the first supporting base 12 and the second supporting base 13 approach each other. Until the second end of the paper roll is fixed by the supporting protrusion part 13*a* of the second supporting base 13, the paper roll is fixed within the paper roll.

For removing the paper roller from the internal portion of the label printer 1, the first supporting base 12 or the second supporting base 13 needs to be pulled out. During the process of pulling out the first supporting base 12 or the second supporting base 13, the first movable track 14 and the second movable track 15 are moved relative to each other through the gear 16. As a consequence, the first supporting base 12 and the second supporting base 13 are distant from each other. Meanwhile, the both ends of the paper roll are no longer securely fixed by the supporting protrusion part 12*a* of the first supporting base 12 and the supporting protrusion part 13*a* of the second supporting base 13, and thus the paper roll may be removed without difficulty.

From the above discussion, the paper roll can be fixed within the internal portion of the label printer 1 by the first supporting base 12 and the second supporting base 13 of the paper roll fixing device 11.

However, the paper roll fixing device 11 of the label printer 1 still has some drawbacks. For introducing the paper roll into the internal portion of the label printer 1, a first end of the paper roll is firstly held by one hand of the user and fixed on the first supporting base 12, and then the distance between the first supporting base 12 and the second supporting base 13 is adjusted by the other hand of the user until the second end of the paper roll is fixed on the second supporting base 13. Whereas, for removing the paper roll, the distance between the first supporting base 12 and the second supporting base 13 is adjusted; and until the both ends of the paper roll are no longer fixed on the first supporting base 12 and the second supporting base 13, the paper roll is removed. In other way, since two hands or at least two steps are necessary to introduce the paper roll into the paper roll fixing device or remove the paper roll from the paper roll fixing device, the operations of the paper roll fixing device are inconvenient to the user.

Therefore, there is a need of providing an improved paper roll fixing device of a printer so as to obviate the drawbacks encountered from the prior art.

SUMMARY OF THE INVENTION

The present invention provides paper roll fixing device of a printer for allowing the user to introduce the paper roll into the paper roll fixing device or remove the paper roll from the paper roll fixing device with a single hand and in a single step.

In accordance with an aspect of the present invention, there is provided a paper roll fixing device of a printer for fixing a paper roll within the printer. The paper roll fixing device includes a first supporting base and a second supporting base. The first supporting base includes a first inner surface, a first outer surface and a first fixing member. The first fixing member includes a first fixing slab, a first shaft and a first elastic element. The first fixing slab further includes a first post. The first shaft and the first elastic element are installed on the first supporting base. The first fixing slab is pivotally connected with the first shaft. The first elastic element is connected with the first fixing slab, so that the first post of the first fixing slab is not protruded outside the first inner surface. The second supporting base includes a second inner surface, a second outer surface and a second fixing member. A space is defined between the first supporting base and the second supporting base for accommodating the paper roll. The second fixing member includes a second fixing slab, a second shaft and a second elastic element. The second fixing slab further includes a second post. The second shaft and the second elastic element are installed on the second supporting base. The second fixing slab is pivotally connected with the second shaft. The second elastic element is connected with the second fixing slab, so that the second post of the second fixing slab is not protruded outside the second inner surface.

In an embodiment, the first supporting base further includes a first position-confining recess in the first outer surface, and the second supporting base further includes a second position-confining recess in the second outer surface. The first elastic element is disposed within the first position-confining recess. The first shaft is arranged under the first elastic element. The second elastic element is disposed within the second position-confining recess. The second shaft is arranged under the second elastic element.

In an embodiment, the first post is arranged at a first end of the first fixing slab, a second end of the first fixing slab is protruded outside the first inner surface of the first supporting base, the second post is arranged at a first end of the second fixing slab, and a second end of the second fixing slab is protruded outside the second inner surface of the second supporting base.

In an embodiment, the first post and the second post have respective slant surfaces for guiding the paper roll to be introduced into or removed from the space between the first supporting base and the second supporting base.

In an embodiment, the first supporting base further includes a first through-hole and a first backing sheet. The second supporting base further includes a second through-hole and a second backing sheet. The first backing sheet is disposed within the first through-hole, and the second backing sheet is disposed within the second through-hole. The first backing sheet further includes a third post protruded outside the first inner surface of the first supporting base. The second backing sheet further includes a fourth post protruded outside the second inner surface of the second supporting base.

In an embodiment, each of the third post and the fourth post further includes two slant surfaces for guiding the paper roll to be introduced into or removed from the space between the first supporting base and the second supporting base.

In an embodiment, the first fixing slab is disposed over the first backing sheet, and the second fixing slab is disposed over the backing sheet. Moreover, the first backing sheet and the second backing sheet are made of flexible materials.

In an embodiment, the paper roll fixing device further includes a first movable track, a second movable track and a rotating wheel. The first movable track and the second movable track are parallel with each other. The rotating wheel is clamped between the first movable track and the second movable track and engaged with the first movable track and the second movable track. An end of the first movable track is connected with the first supporting base. An end of the second movable track is connected with the second supporting base. The first movable track and the second movable track are linearly moved back and forth in a reciprocating manner through the rotating wheel, so that a distance between the first supporting base and the second supporting base is adjustable.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a paper roll fixing device of a printer (e.g. a label printer).

Figure 1A:
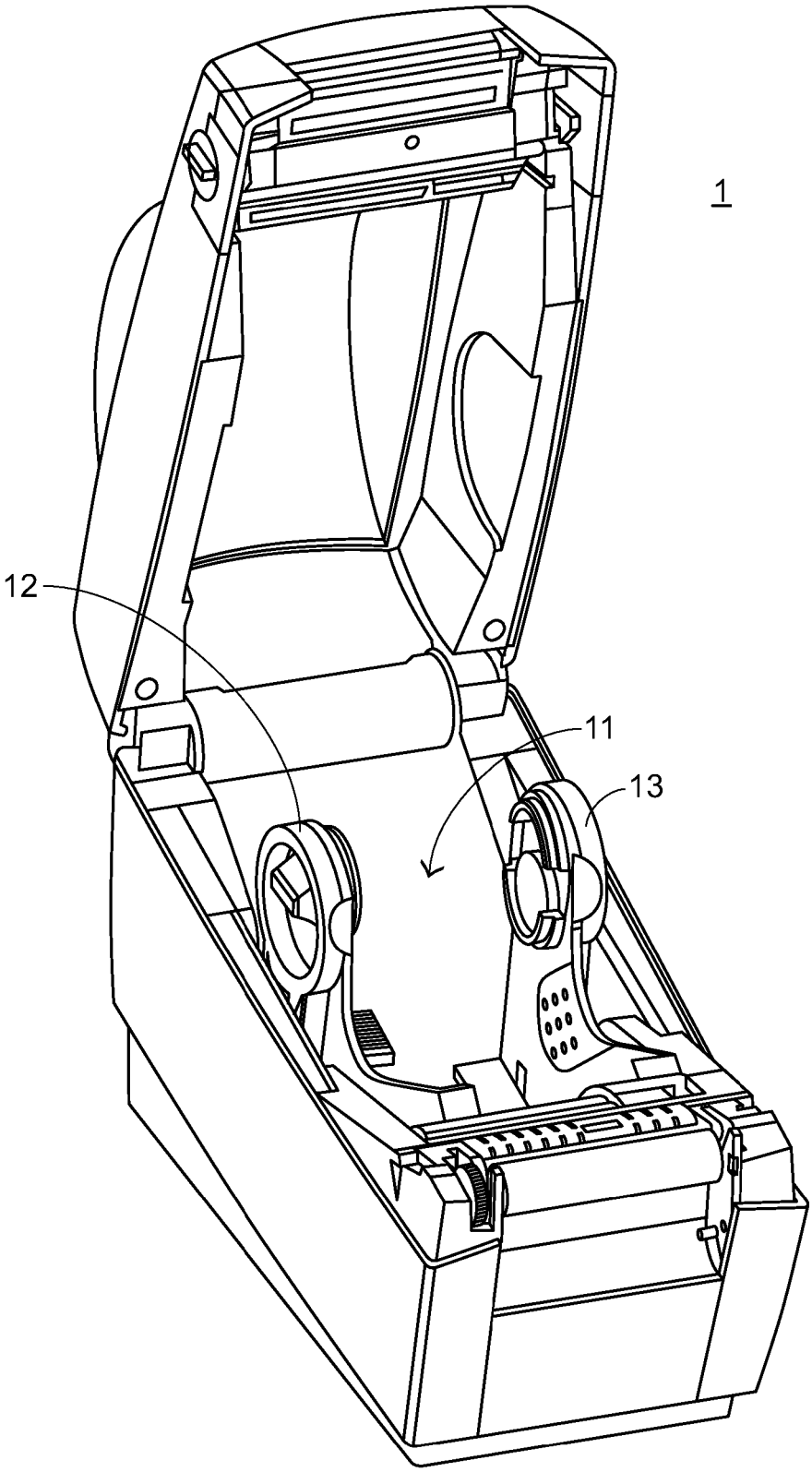
FIG.1A PRIOR ART
FIG. 1A is a schematic perspective view illustrating a label printer according to the prior art.
Figure 1B:
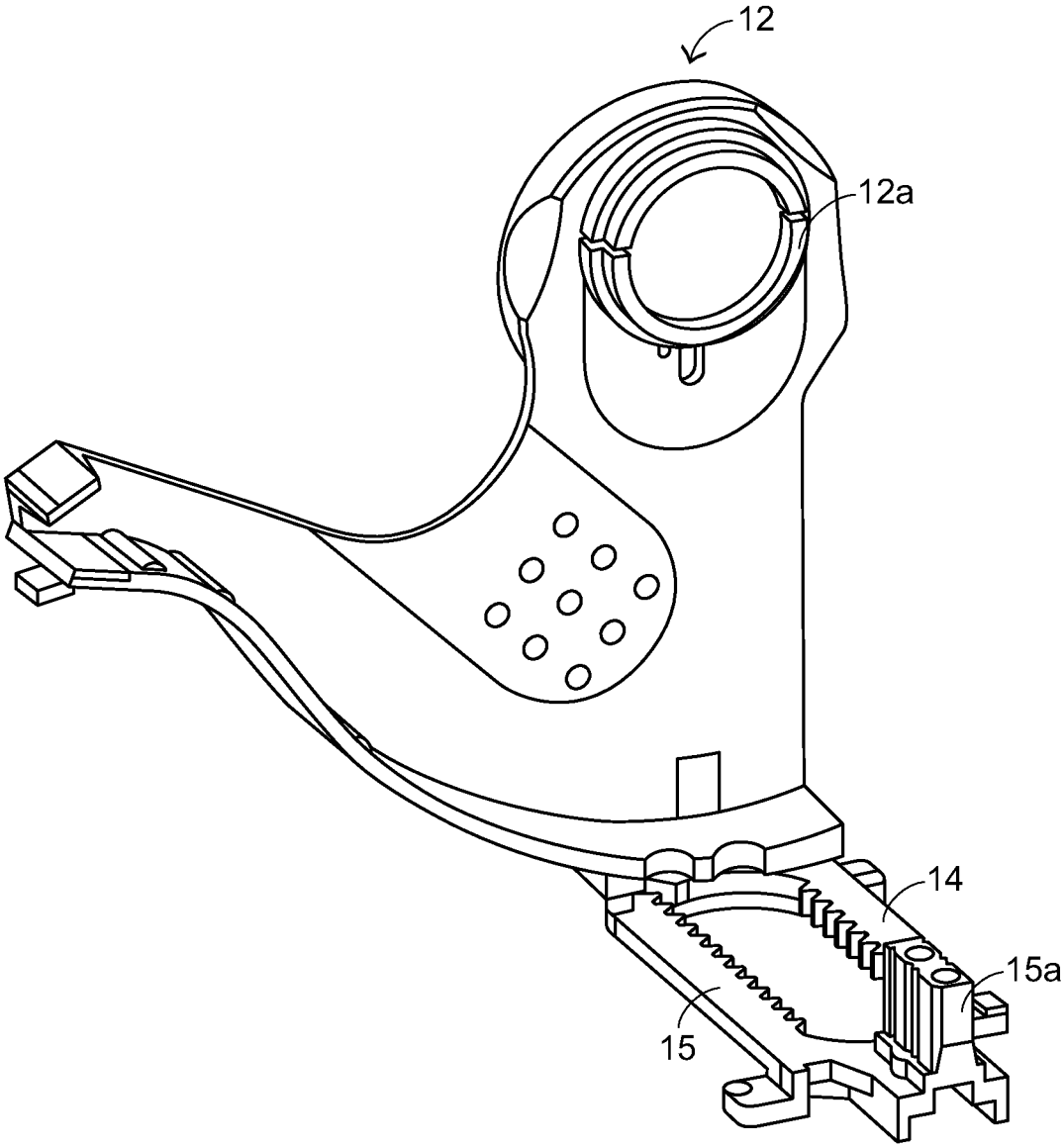
FIG.1B PRIOR ART
FIG. 1B schematically illustrates a first supporting base, a first movable track and a second movable track of the paper roll fixing device of the label printer of FIG. 1A.
Figure 1C:
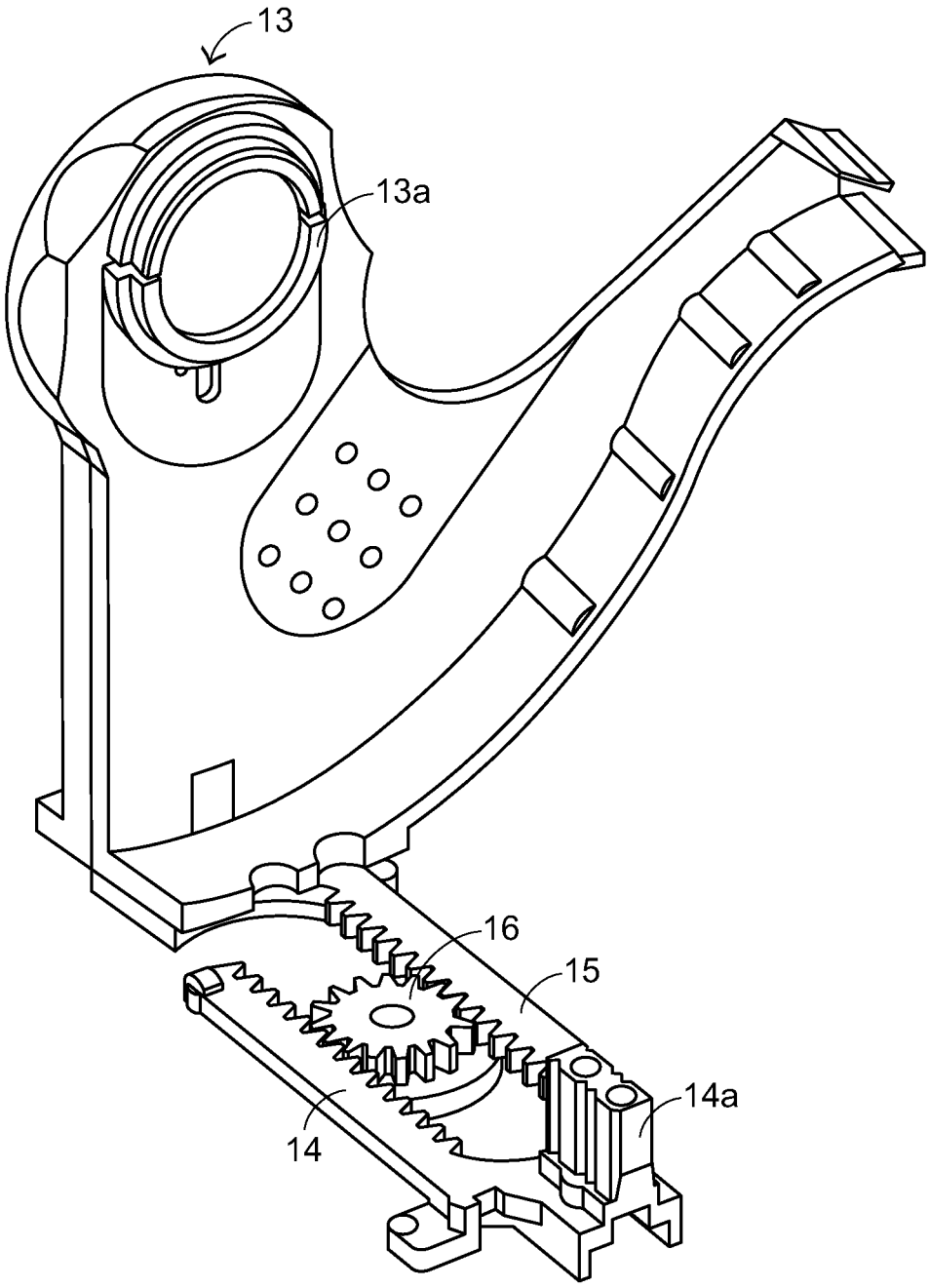
FIG.1C PRIOR ART
FIG. 1C schematically illustrates the second supporting base, the first movable track, the second movable track and the gear of the paper roll fixing device of the label printer of FIG. 1A.
Figure 2A:
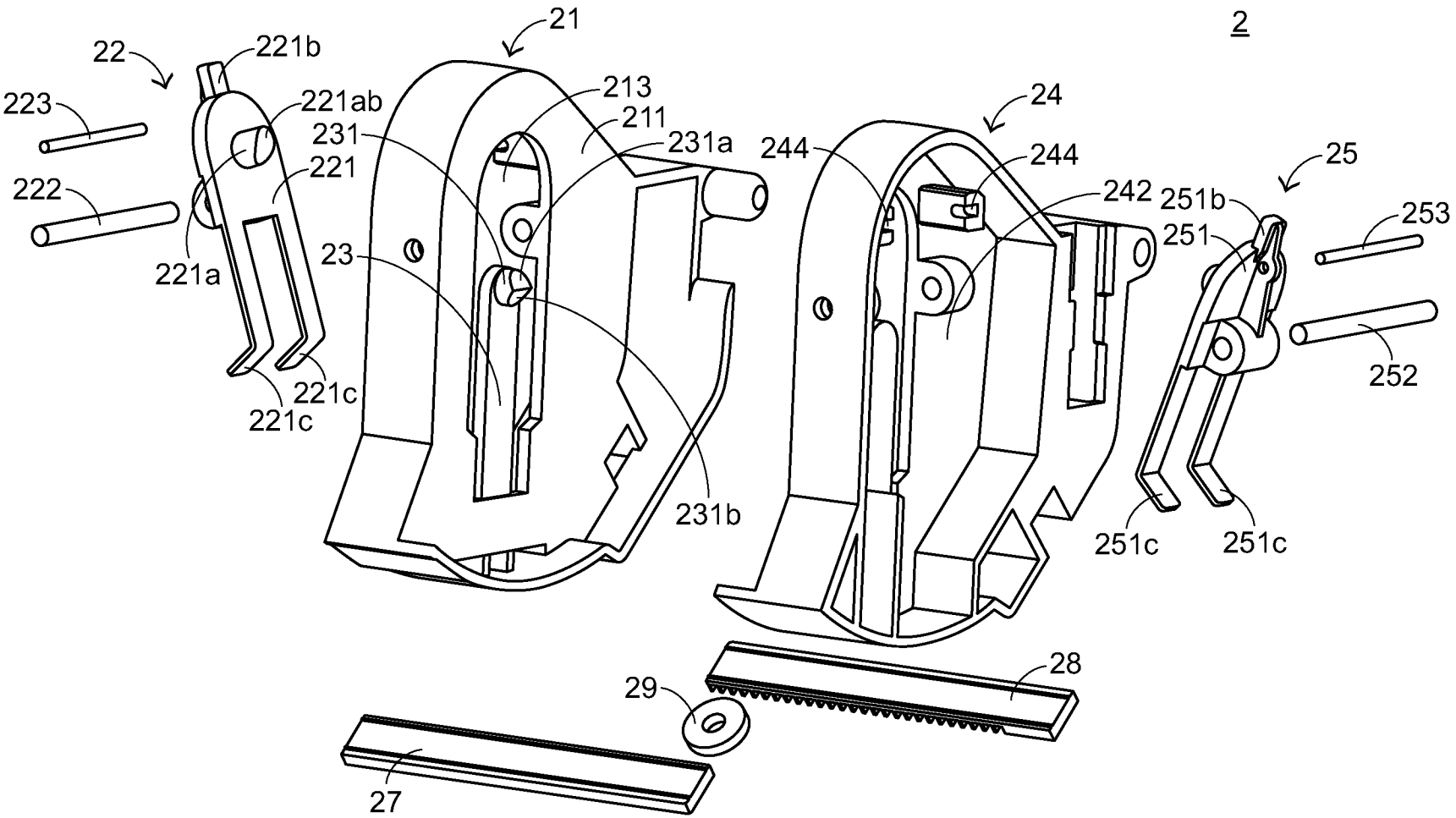
FIG. 2A is a schematic exploded view illustrating a paper roll fixing device of a printer according to an embodiment of the present invention and taken along a first viewpoint.
Figure 2B:
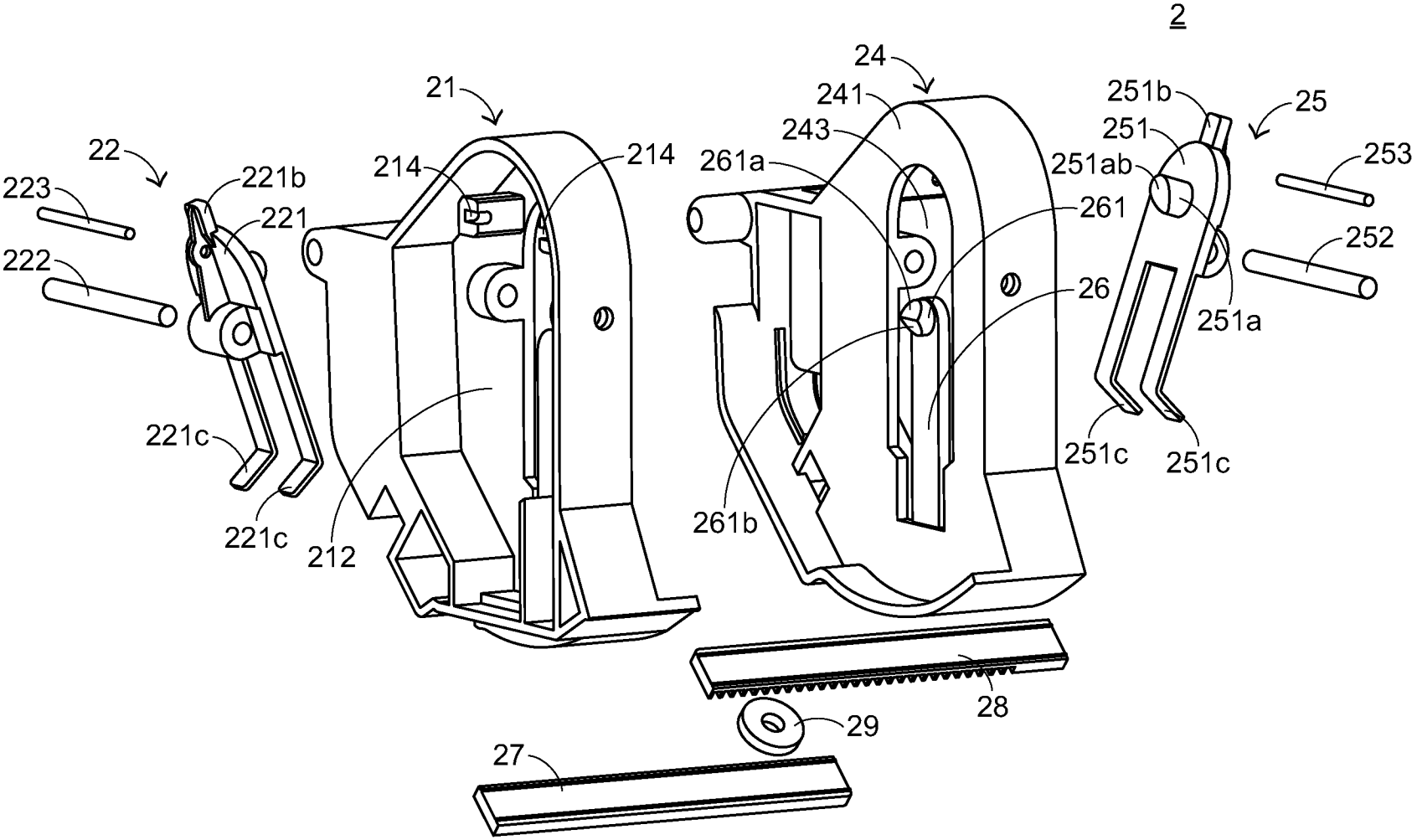
FIG. 2B is a schematic exploded view illustrating a paper roll fixing device of a printer according to an embodiment of the present invention and taken along a second viewpoint.

FIGS. 2A and 2B are schematic exploded views illustrating a paper roll fixing device of a printer according to an embodiment of the present invention and taken along different viewpoints. The paper roll fixing device 2 comprises a first supporting base 21, a second supporting base 24, a first movable track 27, a second movable track 28 and a rotating wheel 29.

The first supporting base 21 comprises a first inner surface 211, a first outer surface 212, a first through-hole 213, a first position-confining recess 214, a first fixing member 22 and a first backing sheet 23. The first position-confining recess 214 is formed in the first outer surface 212. The first fixing member 22 comprises a first fixing slab 221, a first shaft 222 and a first elastic element 223. The first fixing slab 221 further comprises a first post 221*a*. The first post 221*a* has a slant surface 221 ab. The first backing sheet 23 is made of a flexible material. In addition, the first backing sheet 23 comprises a third post 231. The third post 231 has a first slant surface 231*a* and a second slant surface 231*b*.

The second supporting base 24 comprises a second inner surface 241, a second outer surface 242, a second through-hole 243, a second position-confining recess 244, a second fixing member 25 and a second backing sheet 26. The second position-confining recess 244 is formed in the second outer surface 242. The second fixing member 25 comprises a second fixing slab 251, a second shaft 252 and a second elastic element 253. The second fixing slab 251 further comprises a second post 251*a*. The second post 251*a* has a slant surface 251 ab. The second backing sheet 26 is made of a flexible material. In addition, the second backing sheet 26 comprises a fourth post 261. The fourth post 261 has a first slant surface 261*a* and a second slant surface 261*b*.

Figure 3A:
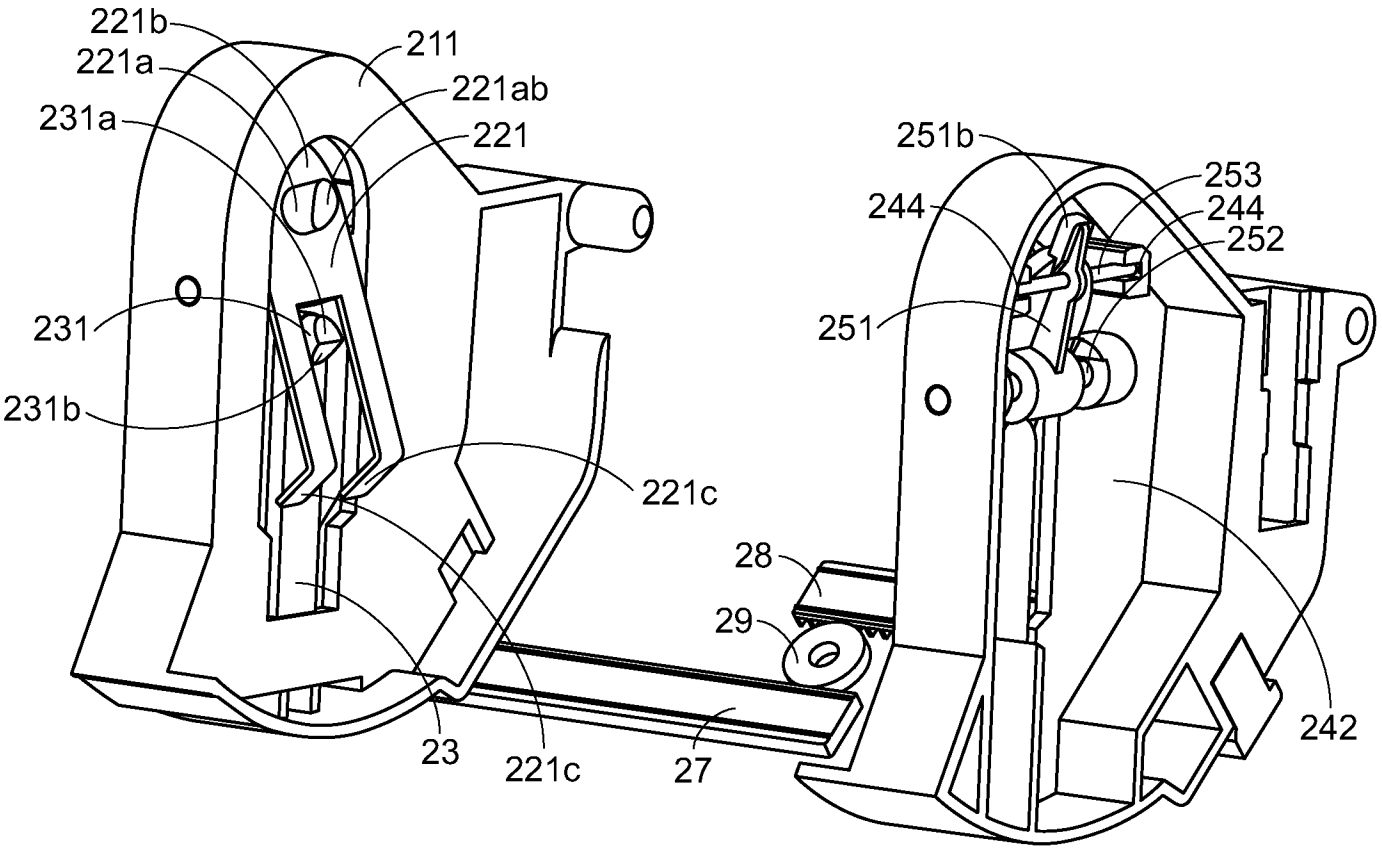
FIG. 3A is a schematic assembled view illustrating a paper roll fixing device of a printer according to an embodiment of the present invention and taken along a first viewpoint.
Figure 3B:
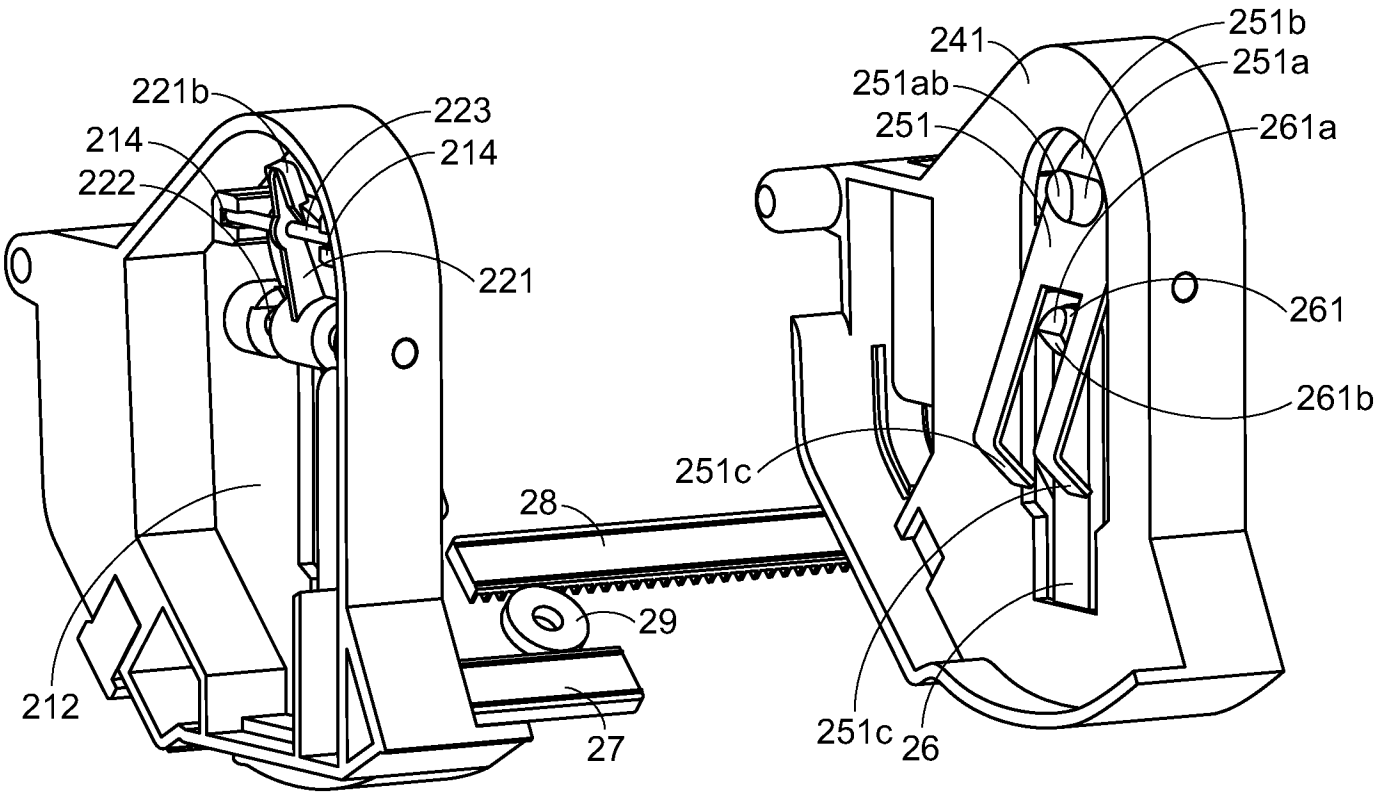
FIG. 3B is a schematic assembled view illustrating a paper roll fixing device of a printer according to an embodiment of the present invention and taken along a second viewpoint.

FIGS. 3A and 3B are schematic assembled views illustrating a paper roll fixing device of a printer according to an embodiment of the present invention and taken along different viewpoints. Please refer to FIGS. 3A and 3B. The first elastic element 223 is disposed within the first position-confining recess 214 of the first supporting base 21 and penetrated through a first end 221*b* of the first fixing slab 221. The first shaft 222 is arranged under the first elastic element 223, and penetrated through a middle portion of the first fixing slab 221. The first backing sheet 23 is disposed within the first through-hole 213, and arranged under the first fixing slab 221. The third post 231 of the first backing sheet 23 is protruded from the first inner surface 211 of the first supporting base 21. The second elastic element 253 is disposed within the second position-confining recess 244 of the second supporting base 24 and penetrated through a first end 251*b* of the second fixing slab 251. The second shaft 252 is arranged under the second elastic element 2523, and penetrated through a middle portion of the second fixing slab 251. The second backing sheet 26 is disposed within the second through-hole 243, and arranged under the second fixing slab 251. The fourth post 261 of the second backing sheet 26 is protruded from the second inner surface 241 of the second supporting base 24.

Moreover, the first supporting base 21 is connected with an end of the first movable track 27. The second supporting base 24 is connected with an end of the second movable track 28. The first movable track 27 and the second movable track 28 are parallel with each other. The both sides of the rotating wheel 29 are clamped between the first movable track 27 and the second movable track 28, and engaged with the first movable track 27 and the second movable track 28. Through the rotating wheel 29, the first movable track 27 and the second movable track 28 may be linearly moved back and forth in a reciprocating manner. In such way, the distance between the first supporting base 27 and the second supporting base 28 is adjustable.

Figure 4A:
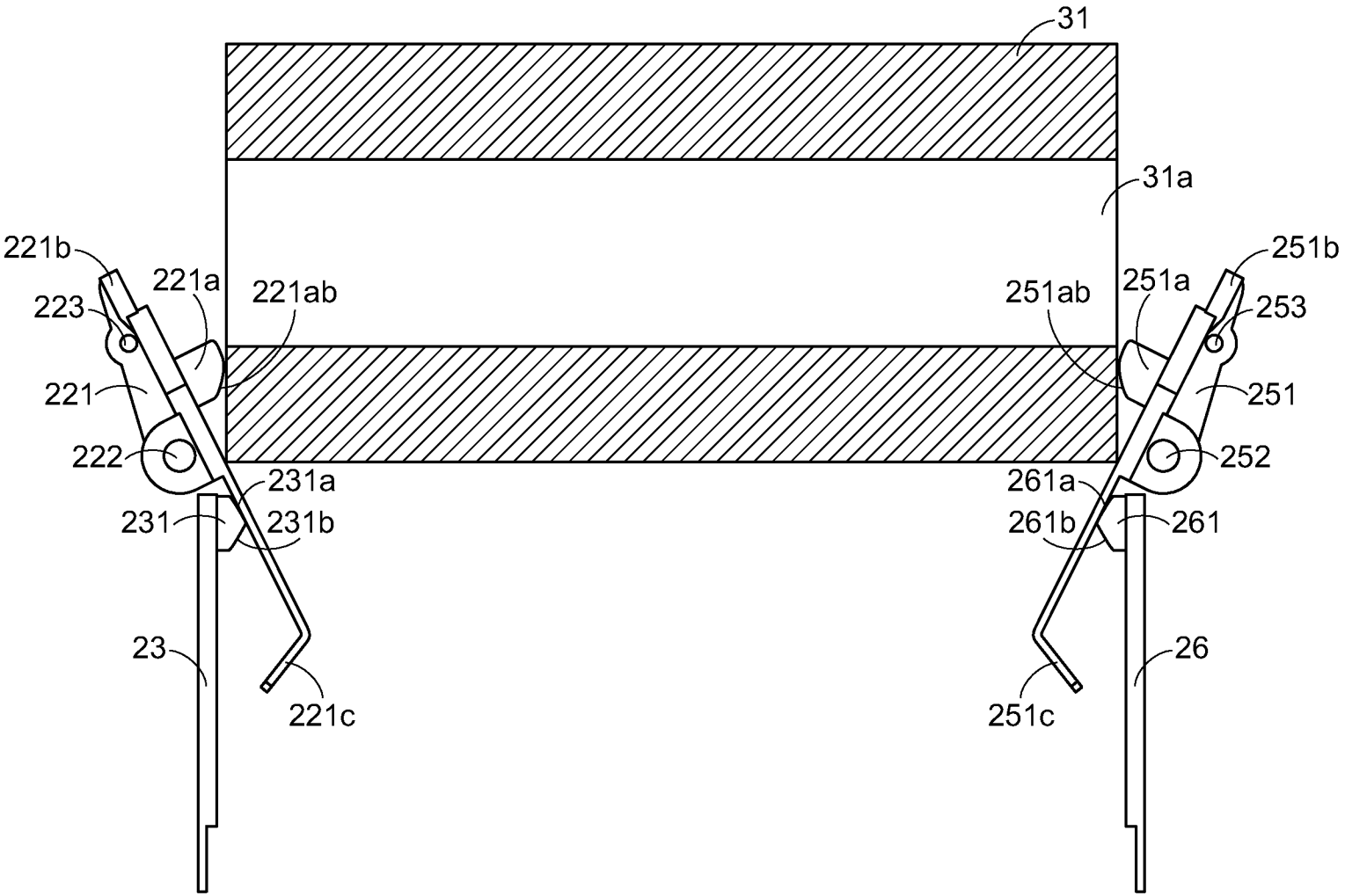
FIG. 4A is a schematic cross-sectional view illustrating a paper roll fixing device of a printer according to an embodiment of the present invention, in which the paper roll has not been installed within the paper roll fixing device.
Figure 4B:
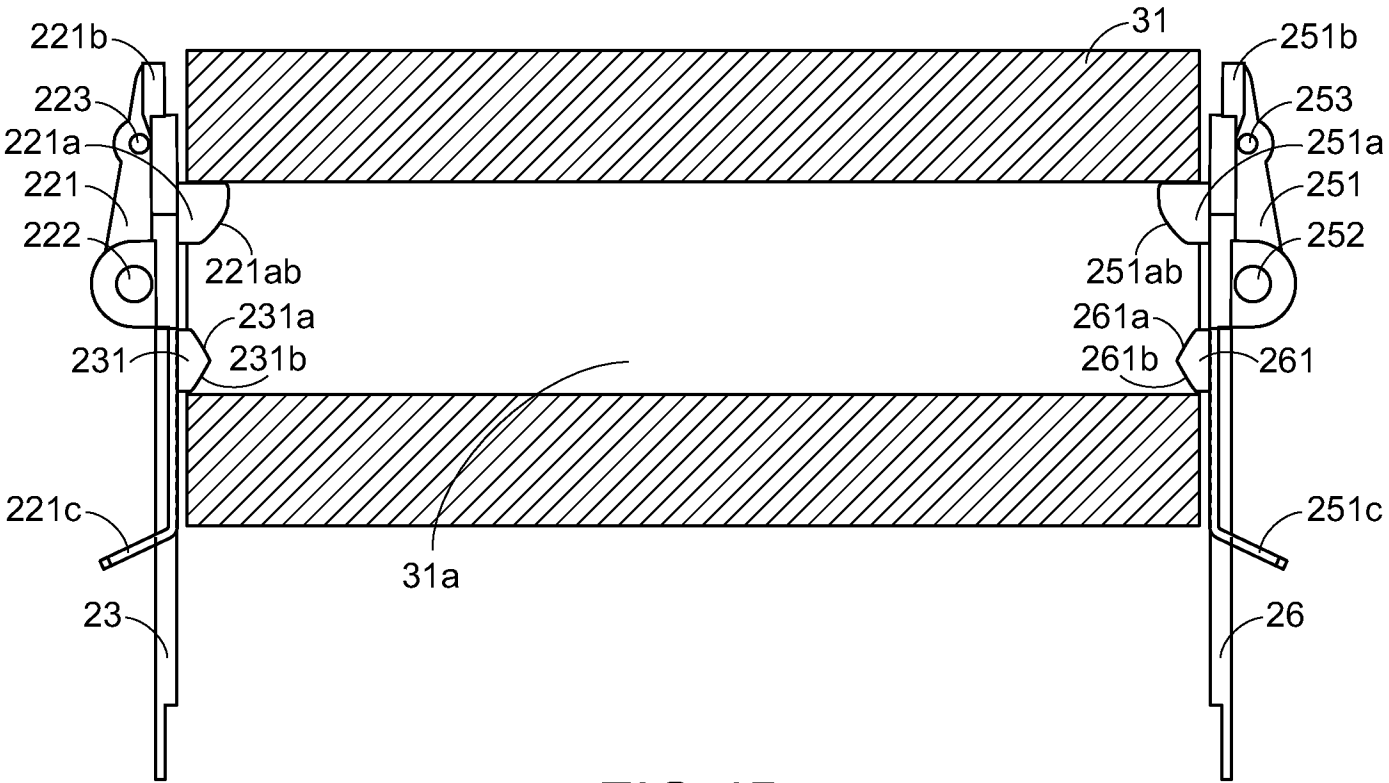
FIG. 4B is a schematic cross-sectional view illustrating a paper roll fixing device of a printer according to an embodiment of the present invention, in which a paper roll has been installed within the paper roll fixing device.

Hereinafter, the operations of the paper roll fixing device according to the embodiment of the present invention will be illustrated with reference to FIGS. 4A and 4B. FIG. 4A is a schematic cross-sectional view illustrating a paper roll fixing device of a printer according to an embodiment of the present invention, in which the paper roll has not been installed within the paper roll fixing device. FIG. 4B is a schematic cross-sectional view illustrating a paper roll fixing device of a printer according to an embodiment of the present invention, in which the paper roll has been installed within the paper roll fixing device.

The paper roll 31 has a central channel 31*a*. Before the paper roll 31 is installed within the paper roll fixing device 2, due to a pulling force of the first elastic element 223, the first end 221*b* of the first fixing slab 221 is rotated toward the first outer surface 212 of the first supporting base 21 by using the first shaft 222 as a fulcrum. Under this circumstance, the first post 221*a* is not protruded outside the first inner surface 211, a second end 221*c* of the first fixing slab 221 is protruded outside the first inner surface 211, and the slant surface 221 ab of the first post 221*a* is parallel with the first supporting base 21. As a result, the paper roll 31 can be smoothly transported across the first post 221*a*. Similarly, due to a pulling force of the second elastic element 253, the first end 251*b* of the second fixing slab 251 is rotated toward the second outer surface 242 of the second supporting base 24 by using the second shaft 252 as a fulcrum. Under this circumstance, the second post 251*a* is not protruded outside the second inner surface 241, a second end 251*c* of the second fixing slab 251 is protruded outside the second inner surface 241, and the slant surface 251 ab of the second post 251*a* is parallel with the second supporting base 24. As a result, the paper roll 31 can be smoothly transported across the second post 251*a*.

During the process of introducing the paper roll 31 into the space between the first supporting base 21 and the second supporting base 24, the second end 221*c* of the first fixing slab 221 and the second end 251*c* of the second fixing slab 251 are pushed by the both ends of the paper roll 31, respectively. Under this circumstance, the second end 221*c* of the first fixing slab 221 is rotated toward the first outer surface 212 of the first supporting base 21 by using the first shaft 222 as a fulcrum, and the second end 251*c* of the second fixing slab 251 is rotated toward the second outer surface 242 of the second supporting base 24 by using the second shaft 252 as a fulcrum. As a result, the paper roll 31 can be smoothly advanced without being stopped. As the paper roll 31 is continuously moved downwardly, the third post 231 of the first backing sheet 23 and the fourth post 261 of the second backing sheet 26 are pressed by the both ends of the paper roll 31. Under this circumstance, the third post 231 is moved toward the first outer surface 212 of the first supporting base 21, the fourth post 261 is moved toward the second outer surface 242 of the second supporting base 24, and the paper roll 31 can be smoothly transported through the region between the first slant surface 231*a* of the third post 231 and the first slant surface 261*a* of the fourth post 231. After the paper roll 31 is completely introduced into the space between the first supporting base 21 and the second supporting base 24, the first fixing slab 221 and the second fixing slab 251 are rotated to be parallel with the first supporting base 21 and the second supporting base 24. Meanwhile, the first post 221*a* of the first fixing slab 221 is protruded outside the first inner surface 211 of the first supporting base 21, and the second post 251*a* of the second fixing slab 251 is protruded outside the second inner surface 2411 of the second supporting base 24. As a result, the first post 221*a* and the second post 251*a* are sustained against the both ends of the top portion of the central channel 31*a* of the paper roll 31. Since the pulling force is no longer exerted on the first backing sheet 23 and the second backing sheet 26, the first backing sheet 23 and the second backing sheet 26 are returned to the original positions due to the toughness properties thereof. As a result, the third post 231 and the fourth post 241 are sustained against the both ends of the bottom portion of the central channel 31*a* of the paper roll 31. In this situation, the paper roll 31 is securely fixed between the first supporting base 21 and the second supporting base 24.

For removing the paper roll 31 from the space between the first supporting base 21 and the second supporting base 24, the paper roll 31 is moved upwardly, so that the third post 231 of the first backing sheet 23 and the fourth post 241 of the second backing sheet 26 are pushed upwardly by the both ends of the paper roll 31. Under this circumstance, the third post 231 is moved toward the first outer surface 212, the fourth post 261 is moved toward the second outer surface 242, and the paper roll 31 can be smoothly transported through the region between the second slant surface 231*b* of the third post 231 and the second slant surface 261*b* of the fourth post 231. At the same time, the second end 221*c* of the first fixing slab 221 and the second end 251*c* of the second fixing slab 251 are no longer pushed by the both ends of the paper roll 31. Due to a restoring force of the first elastic element 223, the first end 221*b* of the first fixing slab 221 is rotated toward the first outer surface 212 of the first supporting base 21 by using the first shaft 222 as a fulcrum. Consequently, the first post 221*a* is returned to the original position, and is no longer protruded outside the first inner surface 211. Similarly, due to a restoring force of the second elastic element 253, the first end 251*b* of the second fixing slab 251 is rotated toward the second outer surface 242 of the second supporting base 24 by using the second shaft 252 as a fulcrum. Consequently, the second post 251*a* is returned to the original position, and is no longer protruded outside the second inner surface 241. Under this circumstance, the paper roll 31 can be removed upwardly. After the paper roll 31 is completely removed, the pulling force of the paper roll 31 is no longer exerted on the third post 231 and the fourth post 261. Consequently, the third post 231 and the fourth post 261 are returned to the original positions due to the toughness properties thereof.

From the above description, by means of the first fixing member 22, the first backing sheet 23, the second fixing member 25 and second backing sheet 26, the paper roll 31 can be securely fixed between the space between the first supporting base 21 and the second supporting base 24 during the paper roll 31 is placed on the paper roll fixing device 2. Moreover, by moving the paper roll 31 upwardly, the paper roll 31 is no longer securely fixed between the space between the first supporting base 21 and the second supporting base 24, so that the paper roll 31 can be smoothly removed. By using the paper roll fixing device of the present invention, the paper roll can be introduced into or removed from the paper roll fixing device with a single hand and in a single step. In such way, the process of replacing the paper roll is time-saving, and the convenience of using the paper roll fixing device is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper roll fixing device of a printer for fixing a paper roll within said printer, said paper roll fixing device comprising:

a first supporting base comprising a first inner surface, a first outer surface and a first fixing member, wherein said first fixing member comprises a first fixing slab, a first shaft and a first elastic element, wherein said first fixing slab further comprises a first post, said first shaft and said first elastic element are installed on said first supporting base, and said first fixing slab is pivotally connected with said first shaft, wherein said first elastic element is connected with said first fixing slab, so that said first post of said first fixing slab is not protruded outside said first inner surface; and a second supporting base comprising a second inner surface, a second outer surface and a second fixing member, wherein a space is defined between said first supporting base and said second supporting base for accommodating said paper roll, wherein said second fixing member comprises a second fixing slab, a second shaft and a second elastic element, wherein said second fixing slab further comprises a second post, said second shaft and said second elastic element are installed on said second supporting base, and said second fixing slab is pivotally connected with said second shaft, wherein said second elastic element is connected with said second fixing slab, so that said second post of said second fixing slab is not protruded outside said second inner surface.

2. The paper roll fixing device according to claim 1 wherein said first supporting base further comprises a first position-confining recess in said first outer surface, and said second supporting base further comprises a second position-confining recess in said second outer surface, wherein said first elastic element is disposed within said first position-confining recess, said first shaft is arranged under said first elastic element, said second elastic element is disposed within said second position-confining recess, and said second shaft is arranged under said second elastic element.

3. The paper roll fixing device according to claim 1 wherein said first post is arranged at a first end of said first fixing slab, a second end of said first fixing slab is protruded outside said first inner surface of said first supporting base, said second post is arranged at a first end of said second fixing slab, and a second end of said second fixing slab is protruded outside said second inner surface of said second supporting base.

4. The paper roll fixing device according to claim 1 wherein said first post and said second post have respective slant surfaces for guiding said paper roll to be introduced into or removed from said space between said first supporting base and said second supporting base.

5. The paper roll fixing device according to claim 1 wherein said first supporting base further comprises a first through-hole and a first backing sheet, and said second supporting base further comprises a second through-hole and a second backing sheet, wherein said first backing sheet is disposed within said first through-hole, and said second backing sheet is disposed within said second through-hole, wherein said first backing sheet further comprises a third post protruded outside said first inner surface of said first supporting base, and said second backing sheet further comprises a fourth post protruded outside said second inner surface of said second supporting base.

6. The paper roll fixing device according to claim 5 wherein each of said third post and said fourth post further comprises two slant surfaces for guiding said paper roll to be introduced into or removed from said space between said first supporting base and said second supporting base.

7. The paper roll fixing device according to claim 5 wherein said first fixing slab is disposed over said first backing sheet, and said second fixing slab is disposed over said second backing sheet, wherein said first backing sheet and said second backing sheet are made of flexible materials.

8. The paper roll fixing device according to claim 1 wherein said paper roll fixing device further comprises a first movable track, a second movable track and a rotating wheel, wherein said first movable track and said second movable track are parallel with each other, said rotating wheel is clamped between said first movable track and said second movable track and engaged with said first movable track and said second movable track, an end of said first movable track is connected with said first supporting base, and an end of said second movable track is connected with said second supporting base, wherein said first movable track and said second movable track are linearly moved back and forth in a reciprocating manner through said rotating wheel, so that a distance between said first supporting base and said second supporting base is adjustable.

* * * * *